US005271336A

United States Patent [19]

Willetts

[11] Patent Number: 5,271,336

[45] Date of Patent: Dec. 21, 1993

[54] RAILROAD CAR WITH RETRACTABLE COVER HAVING CABLE SUPPORTED FUELING TUBE FOR TARPAULIN

[75] Inventor: David P. Willetts, Garibaldi Highlands, Canada

[73] Assignee: B. C. Rail Ltd., North Vancouver, Canada

[21] Appl. No.: 894,280

[22] Filed: Jun. 4, 1992

[30] Foreign Application Priority Data

Nov. 15, 1991 [CA] Canada ..... 2055694

[51] Int. Cl.[5] ..... B61D 39/00

[52] U.S. Cl. ..... 105/377; 296/98; 160/122; 160/273.1

[58] Field of Search ..... 105/377; 296/98, 100; 160/121.1, 122, 66, 68, 271, 273.1

[56] References Cited

U.S. PATENT DOCUMENTS

| | | | |
|---|---|---|---|
| 1,231,874 | 7/1917 | Gallanore et al. | 296/98 |
| 1,318,820 | 10/1919 | Watkins | 296/98 |
| 3,051,232 | 8/1962 | Lamb | 160/273.1 X |
| 3,984,289 | 10/1976 | Sustarsic et al. | 105/377 X |
| 4,003,301 | 1/1977 | Norton | 105/377 X |

FOREIGN PATENT DOCUMENTS

| | | | |
|---|---|---|---|
| 119966 | 9/1984 | European Pat. Off. | 160/66 |
| 141920 | 8/1983 | Japan | 296/98 |
| 1020785 | 2/1966 | United Kingdom | 160/273.1 |

*Primary Examiner*—Robert J. Oberleitner
*Assistant Examiner*—S. Joseph Morano
*Attorney, Agent, or Firm*—Sughrue, Mion, Zinn, Macpeak and Seas

[57] ABSTRACT

A railroad car is provided with a retractable cover for transporting material such as speciality lumber requiring dry conditions or kraft pulp requiring dry ventilated conditions. The retractable covering provides complete protection for the load from all weather conditions and provides access to the load from both sides of the car with overhead clearance for forklift unloading/loading and, in the case of kraft pulp, it allows the product to ventilate and thus avoid interior condensation on the product. A furling system is located lengthwise of the car at the top thereof for storing the cover in an opened position and for paying out the cover when the car is being closed. Guide tracks at both ends of the car are used to lead the edges of the cover to its open and closed positions and the cover is opened and closed by a winch mechanism.

7 Claims, 16 Drawing Sheets

RAILROAD CAR WITH RETRACTABLE COVER HAVING CABLE SUPPORTED FUELING TUBE FOR TARPAULIN

FIELD OF THE INVENTION

This invention relates to railroad cars and in particular to a railroad car construction having a retractable cover.

BACKGROUND OF THE INVENTION

There has for some time been a need for improvements in railroad cars for transporting materials such as speciality lumber which requires dry transporting conditions and for transporting kraft pulp which requires dry and ventilated transporting conditions. Conventionally, material such as speciality lumber is individually wrapped and shipped in longitudinally divided cars but it is not always effective in keeping the shipment dry. With regard to kraft pulp, metal box cars are normally used to ship such a product but box cars have serious drawbacks because hot or warm pulp is often loaded directly into the metal box cars during the winter months in very cold temperatures. This results in extreme moisture, condensation and freezing which damages the pulp and can have deteriorating effects to the interior of the metal cars.

SUMMARY OF THE INVENTION

The present invention addresses the problems of the prior art and conventional car construction for transporting materials of the type referred to above by providing a load divider car or a pulp car, amongst others, in which the covering will provide complete protection for the load from all weather conditions but which will also allow accessability to the load from both sides of the car and, in the one embodiment, with overhead clearance for forklift loading and unloading. In the embodiment of the invention for transporting kraft pulp, the covering also provides ventilation to the product and thus substantially reduces interior condensation from the pulp.

The invention utilizes two tarps attached to a single furling tube assembly suspended between end bulk heads above the framework or top cord of the car. Utilizing a winch system for lowering the tarps simultaneously, they are guided down and around the outside of the load of the car in a grooved track fastened to the car bulkheads. This offers a dual purpose of weather protection sealing and maintains constant alignment of the tarp system. The lower edge of the tarps are then fastened to the side sills of the car to provide further protection from the elements. For the purposes of unloading, the tarps are unfastened from the side sill of the car and utilizing the winch system, the tarps are rewound overhead on the furling assembly. This provides a completely accessible car for standard loading and unloading procedures.

In the embodiment of the invention for transporting such things as speciality lumber, the car is of a divided construction with the furling assembly suspended from bulkhead to bulkhead above the top cord of the central divider structure. The extreme height of a lumber load is above plate "C" clearance and the covering system is then above the load at a total height of approximately 16 feet 10 inches down the center of the car.

In the embodiment of the invention for a pulp car, framework arches are used rather than a central divider structure and the furling assembly is suspended from bulkhead to bulkhead above the framework. The framework arches act as a support for the tarps to keep the tarps above the pulp, particularly the outer corner, which allows for the interior condensation from the drying pulp to run off the inside of the tarps and down the side of the car without damaging the product.

The peak in the arches maintain a desired shape in the tarps for water run off. They also allow for the car to travel in both the empty or loaded configuration with the tarps lowered.

Guide rails, supported by the arches allow the pulp units to be loaded or unloaded on the car in a normal box car pattern. The load is then contained on the car with no need for extra securement.

The rails and arches also act as a deterrent for a forklift driver to prevent running off the other side of the car.

The roll-up tarps give the following advantages:

(a) with the tarps rolled up above the car, the likelihood of damage due to a forklift is eliminated;

(b) an open car gives improved visibility to a forklift operator for added driver safety and improved control of product damage;

(c) the doorway opening for forklift access is increased to approximately 19 feet compared to the usual boxcar door opening of approximately 14 feet. This also improves driver safety and decreases likelihood of product damage. The need for doors and door posts are also eliminated.

The invention comprises five major components, a furling system, the bulkhead tracks and the bulkhead additions, the covering tarps, the winch loading mechanism and, in the case of a pulp car, the framework.

The furling system includes a cable suspended above the top cord from brackets attached to each bulkhead along the center line of the car and over this cable is provided a tube of extruded metal such aluminum with a groove down each side for attaching the tarps, the tube extending the full length of the car between the bulkheads. A chain drive or other suitable system is used to rotate the tube to raise or lower the tarps.

The tarps are attached to the furling tube by means of a bolt rope and this allows the tarps to rotate or furl around the tube when the cover is being opened. When the tarps are rolled out to cover the load, the point where the tarps are fed along the tube provides a seal to prevent water from entering at the peak of the roof.

By way of example, tension in the cable which extends between the bulkheads and which supports the furling tube is approximately 10,000 pounds to minimize sag and thus prevent the tube or the tarps from excessive wear when the car is in motion. This tension is achieved using a turnbuckle tensioning system located at one end of the car. Should the cable stretch after a period of service, tension can then be taken up with such a system.

In a preferred embodiment, the cable is approximately one half inch diameter and is galvanized steel to extend the service life thereof and has a breaking strength of approximately 22,500 pounds. To prevent damage to the cable and furling system due to a shifted load bending a bulkhead, the cable attachment bracket located at the opposite end of the car is designed to yield at approximately 17,000 pounds.

An aluminum, or other suitable alloy, extruded track follows just outside the outline of a load on the divided car or of the framework on a pulp car and is attached to the insides of the bulkheads. The edges of the tarps travel inside the track and provide a weather seal on the ends of the car. The track is extruded and has a groove slot running the full length for the tarp edge to run in. This provides a smooth internal surface with a tarp edge and also provides a weather seal to prevent moisture from entering the car along the bulkheads. The track is of sufficient strength to withstand forklift banging and uses a solid cross section. The track extends down past the top edge of the side sill to ensure a seal on the ends and a stainless steel feeding mechanism is used at the top entry of the track to ensure trouble free entry of the tarp into the track.

A steel plate addition on top of the bulkheads serves as a support for the top portion of the track and also is a skin to protect the load from the elements. This plate is secured directly to the top of the bulkheads with gussets added for stiffness.

The tarpaulins can be manufactured from any suitable material, one such material being a vinyl coated polyester such as FALTEX 1861 currently used for truck tarpaulins. This material is waterproof, fire retardant, UV resistant and can withstand temperatures to 50° below zero Fahrenheit. The material will not tear. Each tarp is approximately 55 feet long and 16½ feet wide and weighs approximately 130 pounds. In the embodiment for a pulp car, each tarp has additional reinforcing strips to prevent wear on the tarp along the arches. In the other embodiment, the tarp has a reinforcing strip located at the top edge of the load to provide additional protection. The tarp seams are stitched and welded together to avoid breakdown of the stitching.

The side edges of the tarps have a wire rope sewn inside a TEFLON tape to slide inside the bulkhead tracks. The wire core rope is extended an extra fifty to one hundred feet beyond the bottom edge of the tarp to connection the lowering system. The use of a wire core rope extends the life compared to normal rope and also will prevent possible cutting thereof. The TEFLON tape provides better wear resistance in sliding in the groove and also provides less friction.

The top edge of tarps have a hardbraided rope sewn inside a VCP or DACRON tape to the tarp material, this slides inside the furling attachment tube to attach the tarp to the tube and to allow the furling concept to be achieved.

The tarps have additional wear patches placed at the top corners and the outer corners of the load to prevent wear in these higher stress areas. The bottom edge of each tarp has webbing with attached "D" rings and rubber rope sewn in to provide a means for securing the bottom edge of the tarp to the side sill of the car. The mechanism for lowering the tarp consists of a winch located inside the bulkhead at one end of the car with a shaft for winding on the wire core rope extending out of the tarp edges. The winch is driven with a chain and sprocket reduction system to allow easy operation by one man. The four wire core rope extensions off the tarps run inside an aluminum extruded track on the bulkheads and come out at the bottom corners. The ropes at the "B" end of the car are then fed around a pulley at each corner and send along the bottom of the side sill inside a pipe or protective steel angle, for protection. They are then sent around two pulleys at the "A" ends of the car and inside the bulkhead to be secured to the winch shaft. The ropes at the "A" end are also taken around two pulleys and sent inside the bulkhead to secure to the winch shaft. When the winch is driven all four corners of the tarps are pulled down to cover the load.

According to a broad aspect, the invention relates to a railroad car with a retractable cover, said car having a bulkhead at each end thereof; said retractable cover comprising (a) a pair of tarpaulins each of which is adapted to cover approximately one half of said car between the bulkheads thereof; (b) a pair of tracks on each bulkhead for guiding said tarpaulins over a load on said car from open to closed positions; (c) a furling system extending the length of said car between said bulkheads and located between the peaks thereof, said furling system anchoring the upper ends of said tarpaulins; and (d) apparatus connected with said furling system and said tarpaulins for (a) drawing said tarpaulins off the furling and along said bulkhead tracks to cover a load and close the car and b) for rotating the furling system to retract the tarpaulins and open the car.

BRIEF DESCRIPTION OF THE DRAWINGS

The invention is illustrated by way of example in the accompanying drawings in which:

(FIG. 10 item 52 shows furling tube in an extruded state);

DETAILED DESCRIPTION OF THE PREFERRED EMBODIMENTS

Figure 1:
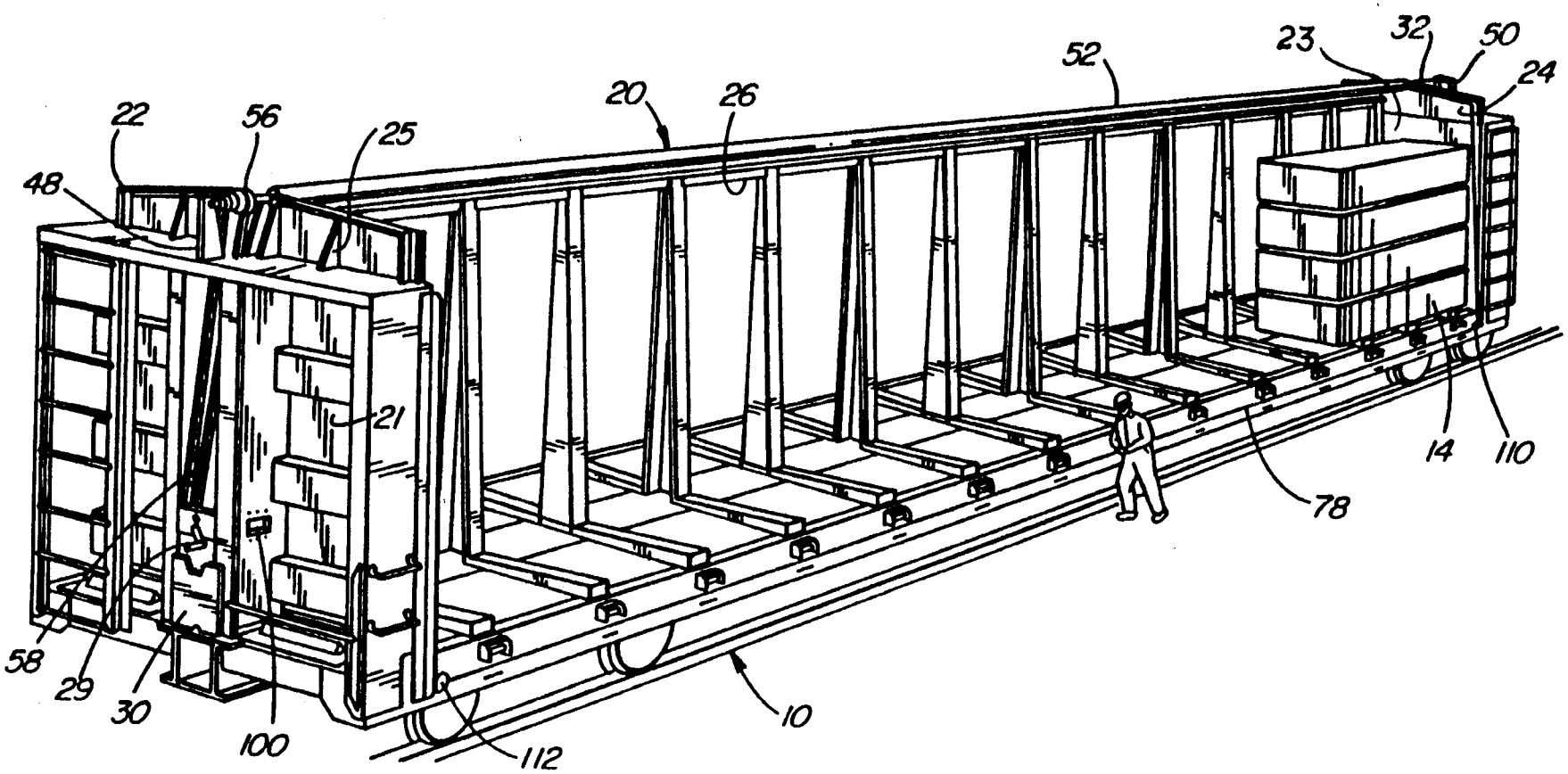
FIG. 1 is a perspective view of a center beam railway car according to the present invention with the covering in the open position.
Figure 2:
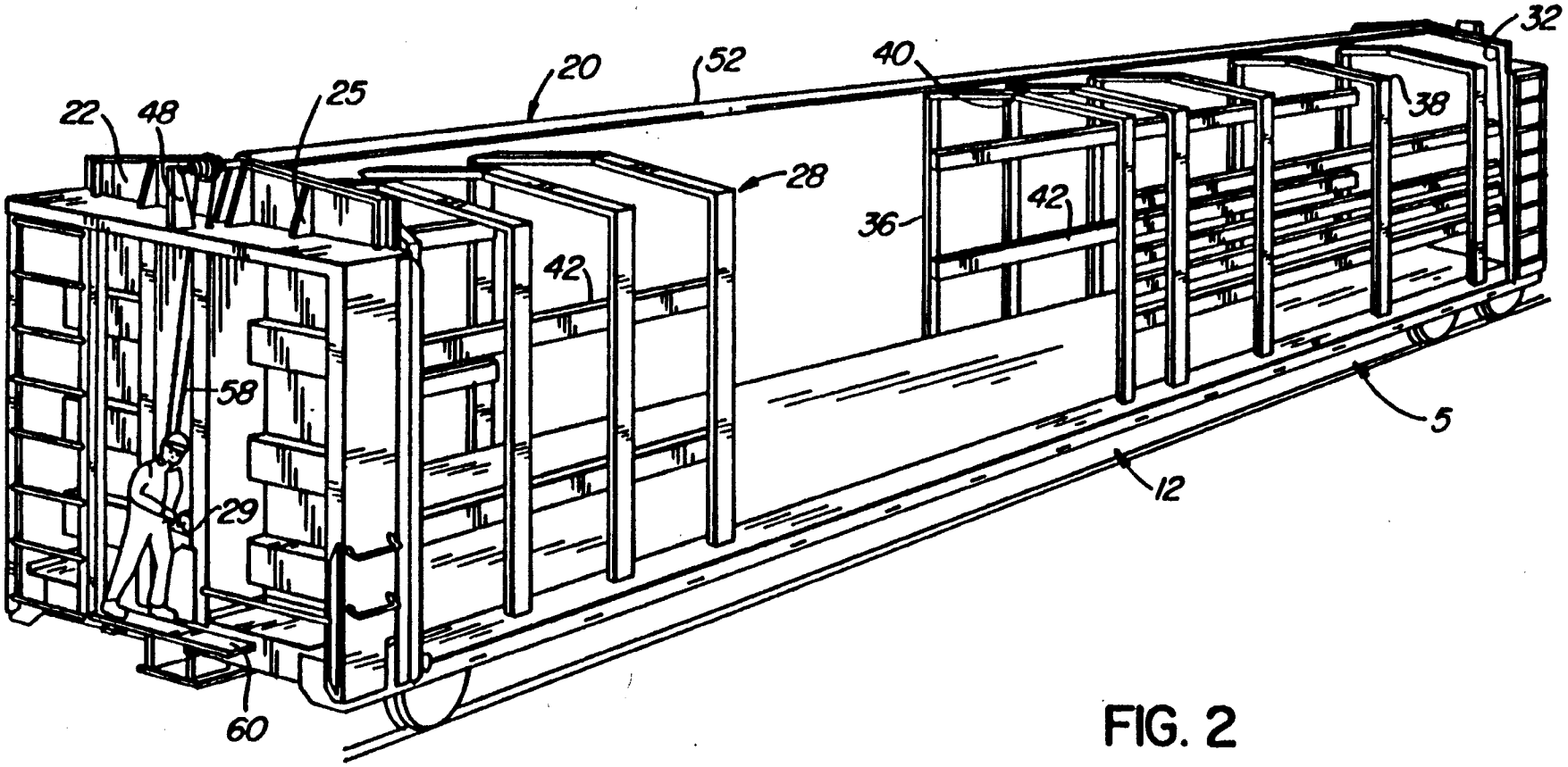
FIG. 2 is a view similar to FIG. 1 but showing another embodiment of the invention for the transporting of kraft pulp and again with the covering in the open position.
Figure 3:
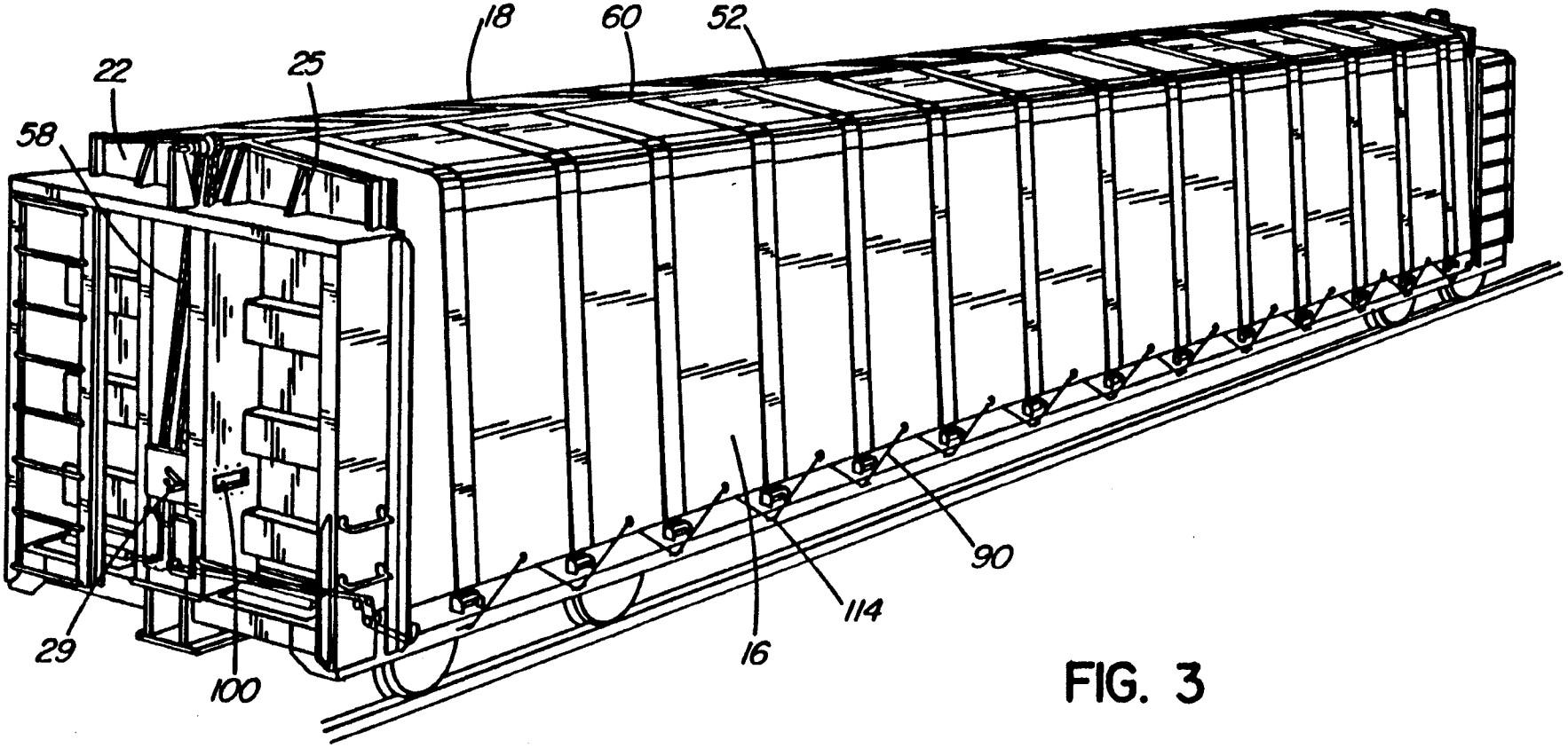
FIG. 3 shows the car in FIGS. 1 or 2 with the covering in the closed position.

Referring initially to FIGS. 1, 2 and 3, FIG. 1 discloses a center-beam railroad car 10 generally referred to as a load divider car and it is designed specifically for transporting such things as speciality lumber 14, the load being accessible from both sides of the car 10 and with overhead clearance for forklift loading or unloading when the covering of the car is removed.

Car 12 shown in FIGS. 2 and 3 is a pulp car designed for transporting kraft pulp and which requires dry ventilated conditions. The covering provides complete protection for the load from all weather conditions as well as allowing the product to ventilate and thus avoid interior condensation on the product as is the case with enclosed box cars and the like. Again, car 12 can be loaded or unloaded from both sides thereof.

General Description

Figure 16:
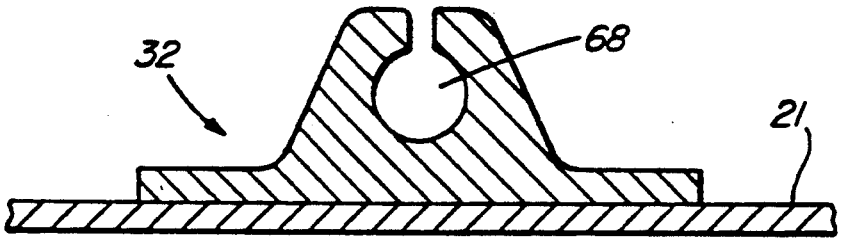
FIG. 16 is a sectional view taken along the lines 16—16 of FIG. 15*b*.
Figure 17:
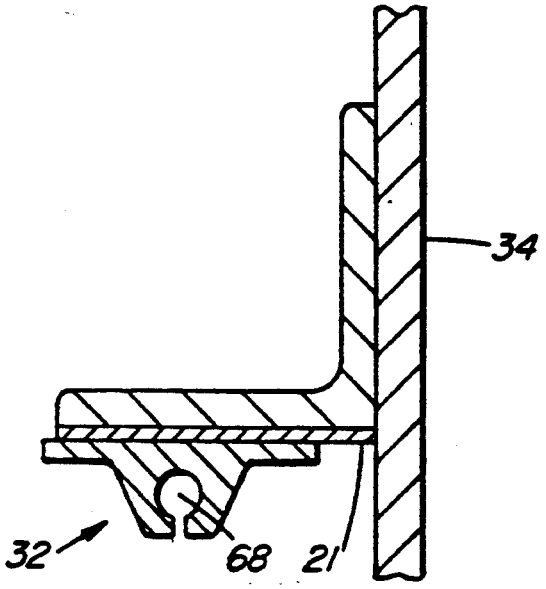
FIG. 17 is a sectional view taken along the lines 17—17 of FIG. 15*c*.

The cover of the cars 10 or 12 consists of two tarps 16, 18 as shown in FIG. 3 attached to a single furling assembly indicated generally at 20 and which is suspended above the bulkheads at the end of the cars by bulkhead extensions 22 at the "A" end and 24 at the "B" end of the car, above the top cord 26 of the divided car and above the framework 28 of the pulp car. Using a winch system 30 (see FIGS. 3 and 7) the tarps 16 and 18 are lowered simultaneously and they are guided down and around the outside of the load in a grooved track 32 (see also FIGS. 15–17) which is fastened to the bulkheads 21 and 23 of the car. This structure offers the dual provision of weather protection sealing and maintaining constant alignment of the tarp system. As shown in FIG. 3, the lower edge of the tarps are then fastened to the side sills 34 of the car to provide further protection from the elements. For unloading, the tarps are unfastened from the side sill and utilizing the winch system 30, the tarps 16 and 18 are rewound overhead on the furling assembly 20. Referring to FIG. 2, the frame arches 36 act as a support for the tarps 16, 18, to keep them above the pulp (not shown) especially the outer corner 38 which allows for the interior condensation from the drying pulp to run off the inside of the tarps and down the side of the car without damaging the product. The peak 40 in the arches maintain the desired shape in the tarp 16, 18 for water run off. They also allow for the car to travel in both the empty or loaded configuration with the tarps lowered. The guide rails 42, supported by the arches 36, allow the pulp units to be loaded or unloaded on the car 12 in a normal box car pattern. The load is then contained on the car 12 with no need for extra securement.

The roll-up tarps 16, 18 also give the advantages that, with the tarps rolled up above the car 12, the likelihood of damage due to a forklift is eliminated. Additionally, the open car 12 gives improved visibility to the forklift operator for added driver safety and improved control of product damage.

The doorway opening for forklift access is increased to approximately 14 feet. This improves driver safety and decreases likelihood of product damage. The need for doors and door posts are also eliminated.

Furling System FIGS. 4—6, 18 and 19

Figure 10:
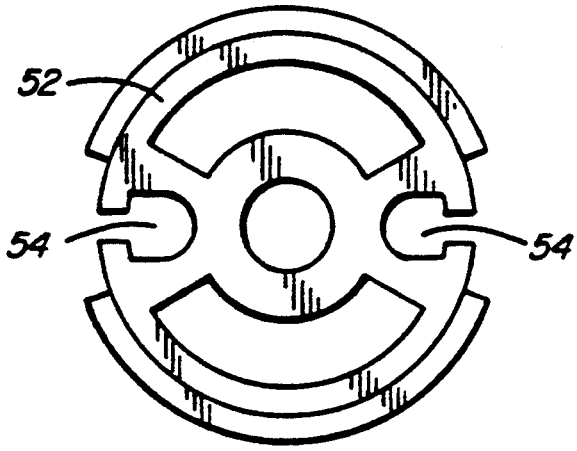
FIG. 10 is an end view of the furling tube with attached splice plates.

The furling system 44 consists of a cable of sufficient strength such as a half inch diameter steel cable 46 which is suspended above the top cord of the car from brackets 48 and 50 which are attached to the bulkheads 21 at the "A" end and 23 at the "B" end of the car along the centerline thereof. The attachment point is located at approximately 20½ inches above the top of the bulkheads and over this cable a 2 inch diameter tube 52 of extruded aluminum with a groove 54 down each side thereof (FIG. 10) for attaching the tarp 16, 18, is extended the full length of the car as shown in FIGS. 1, 2 and 3. Tube 52 has a sprocket gear 56 fitted on to the tube a the "A" end of the car and which is rotated by a chain drive system 58 which is located above the coupler on the "A" end of the car inside the bulkhead thereof. As shown in FIGS. 2 and 3, an operator stands on a protected platform 60 which is located at loading platform height and facing the center end pressing. From this location, the operator can rotate the handle 29 of a winch 30 which drives the chain, rotates the sprocket 56 and in turn rotates the furling tube 52.

The two tarps 16 and 18 are attached to the furling tube 52 by means of a bolt rope fed internally along each groove 54 (FIG. 10) of the tube 52 which allows the tarps 16, 18 to rotate or furl around the tube 52 when opening the cover. When the tarps are rolled out to cover the load, the point where the tarps 16, 18 are fed along this tube provide a seal 60 (FIG. 3) to prevent water from entering at the peak of the roof.

Figure 4:
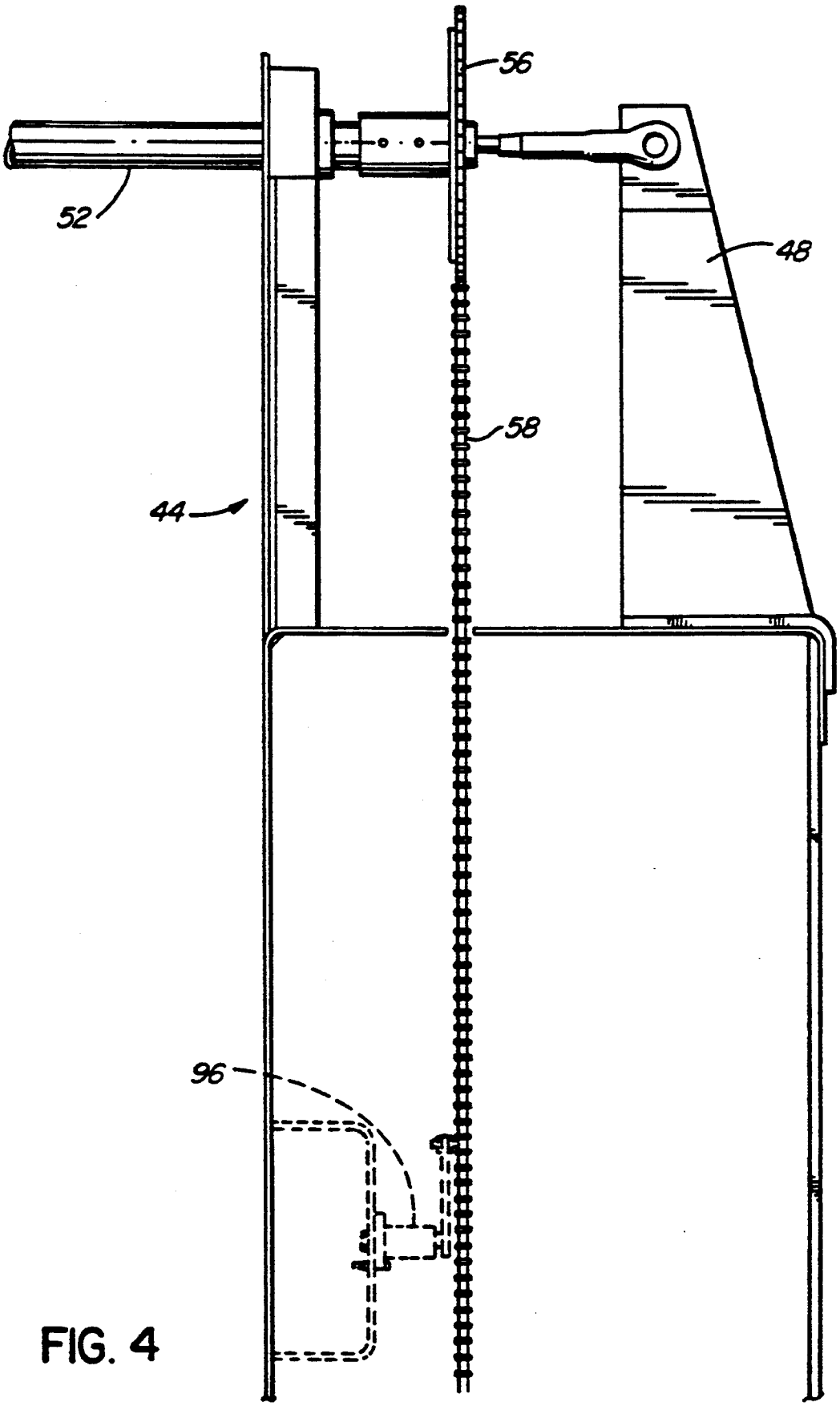
FIGS. 4 and 5 are fragmentary sectional views of portions of the ends of the cars shown in FIGS. 1 or 2, FIG. 4 showing the "A" end and FIG. 5 showing the "B" end.
Figure 5:
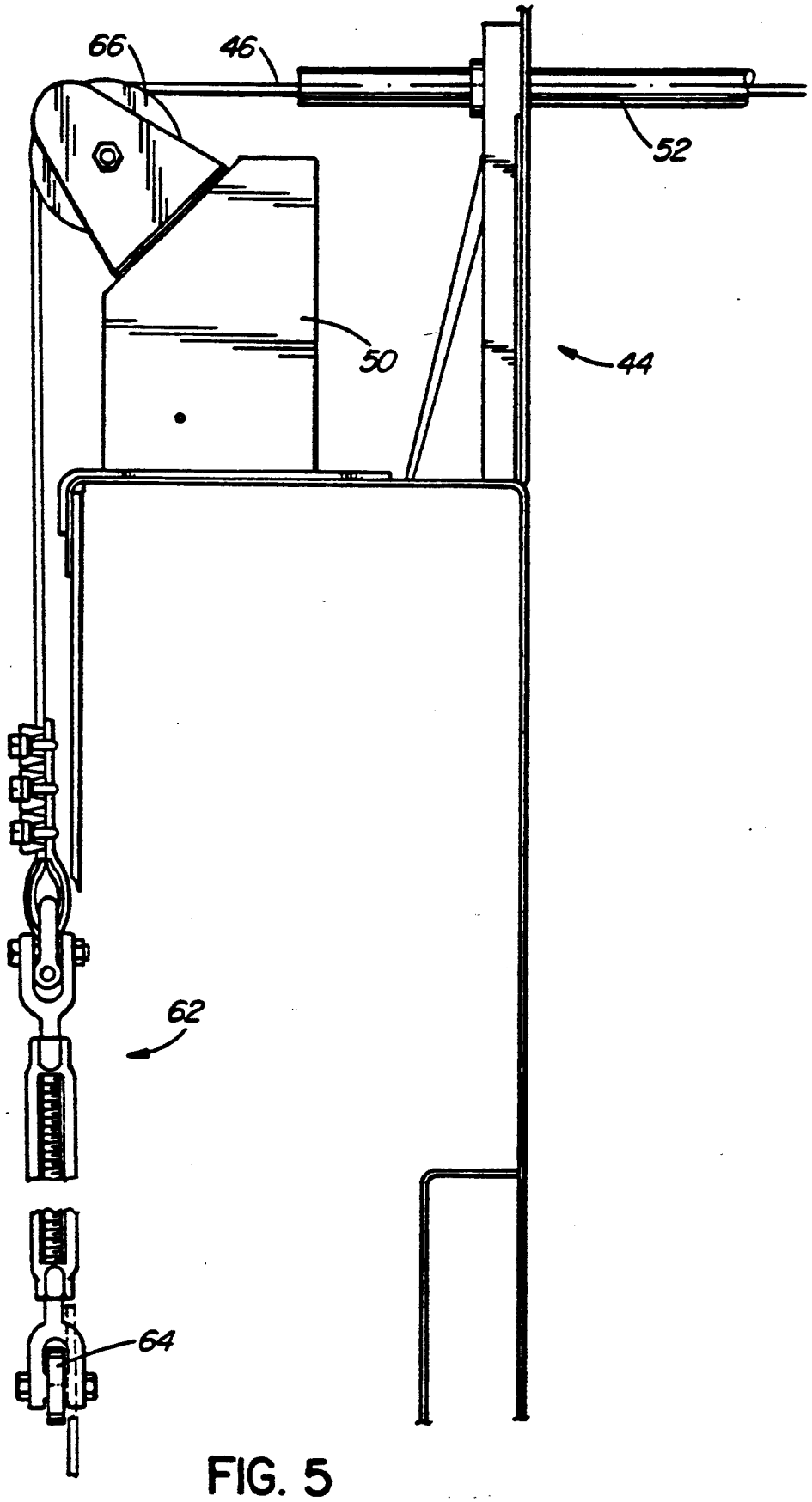
Figure 6:
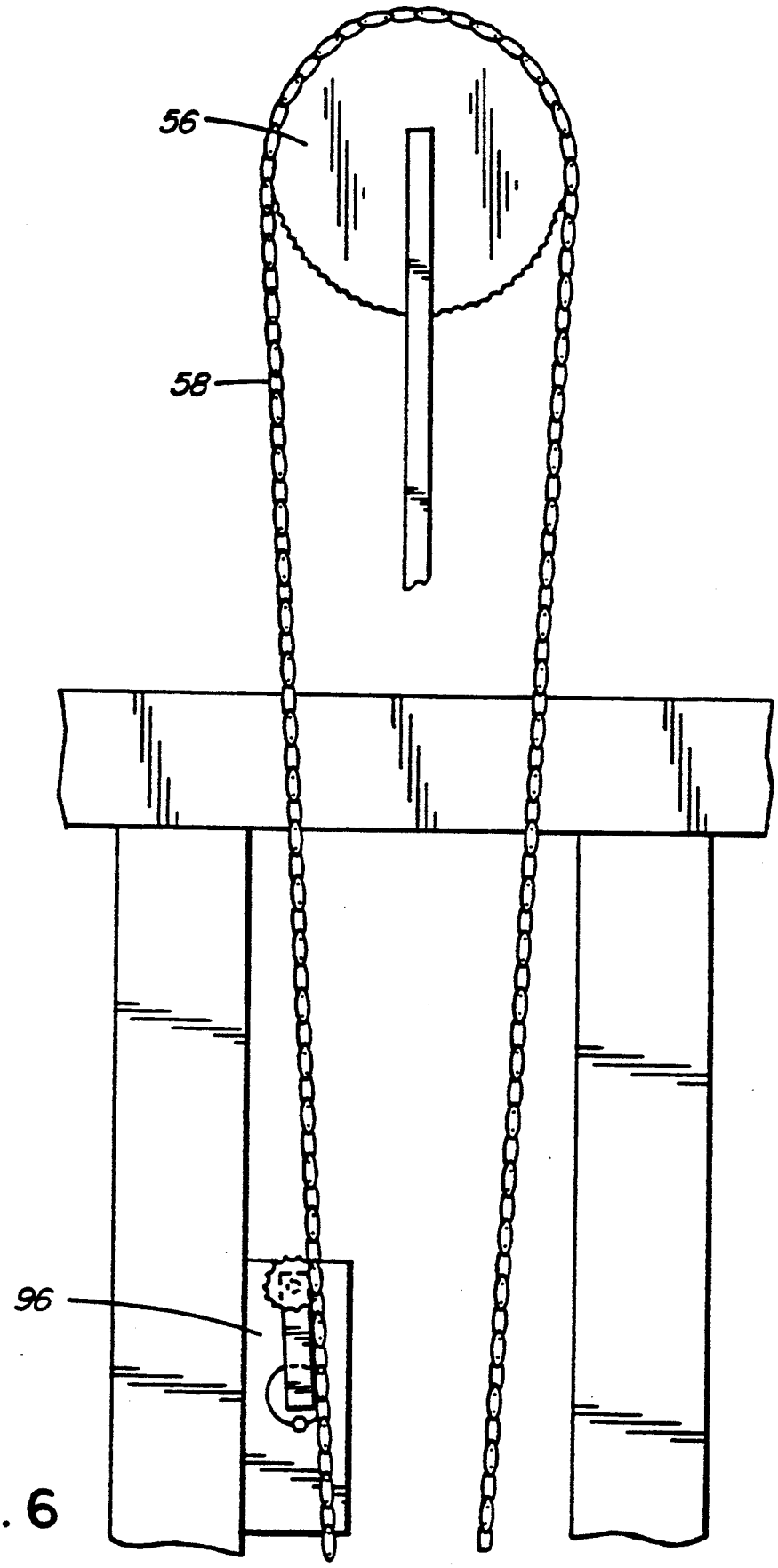
FIG. 6 is an end view of FIG. 4.

Referring to FIGS. 4 and 5 which refer to the "A" and "B" ends respectively of the car, tension is applied to the steel cable 46 to approximately 10,000 pounds to minimize sag and thus prevent the tube 52 or the tarps 16, 18 from excessive wear when the car is in motion. The tension is achieved using a turnbuckle tensioning system 62 located at the "B" end of the car. Should the cable 46 stretch after a period of service, tension can then be taken up by suitable adjustment of the turnbuckle assembly, the terminal end of which is connected to a cable anchor 64.

As seen in FIG. 5, the cable 46 is trained around a pulley 66 mounted in a cable attachment bracket 50, the other end of the cable 46 at the "A" end of the car being connected to bracket 48. The half inch diameter cable is galvanized steel and has a breaking strength of approximately 22,500 pounds. To prevent damage to the cable and the furling system due to a shifted lumber load bending the bulkhead, or the like, the cable attachment bracket 50 is designed to yield at 17,000 pounds.

Track and Bulkhead Structure FIGS. 15–17, 19

Figure 15A:
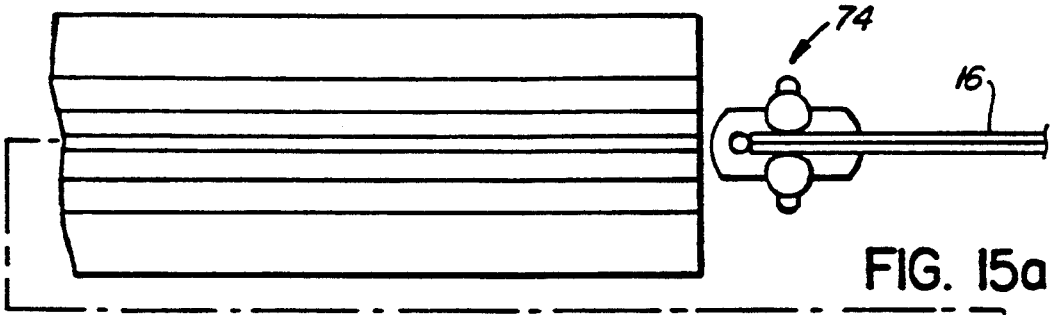
FIGS. 15*a*, 15*b* and 15*c*, together, form an end view of the bulkhead track as viewed from the center of the car.
Figure 15B:
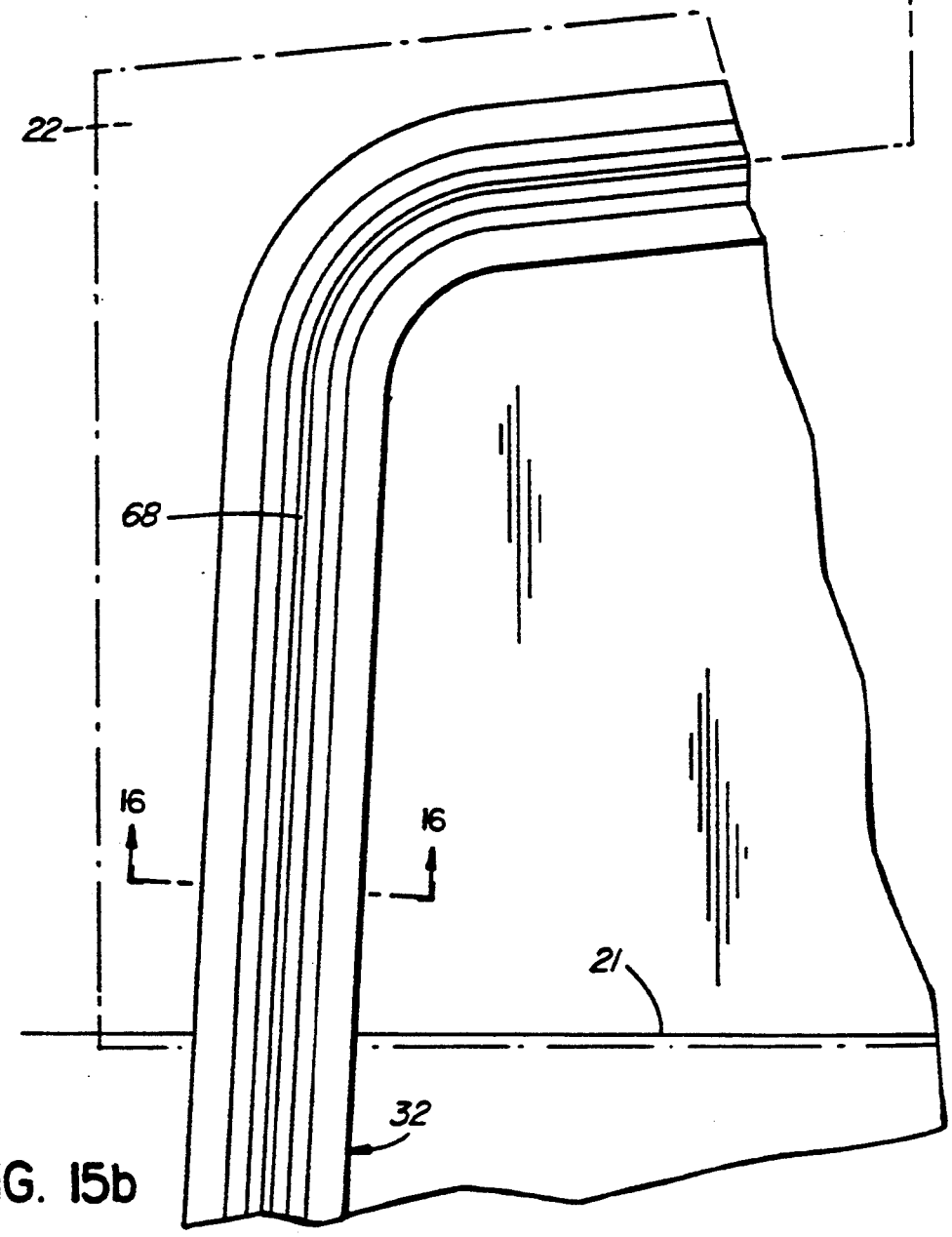
Figure 15C:
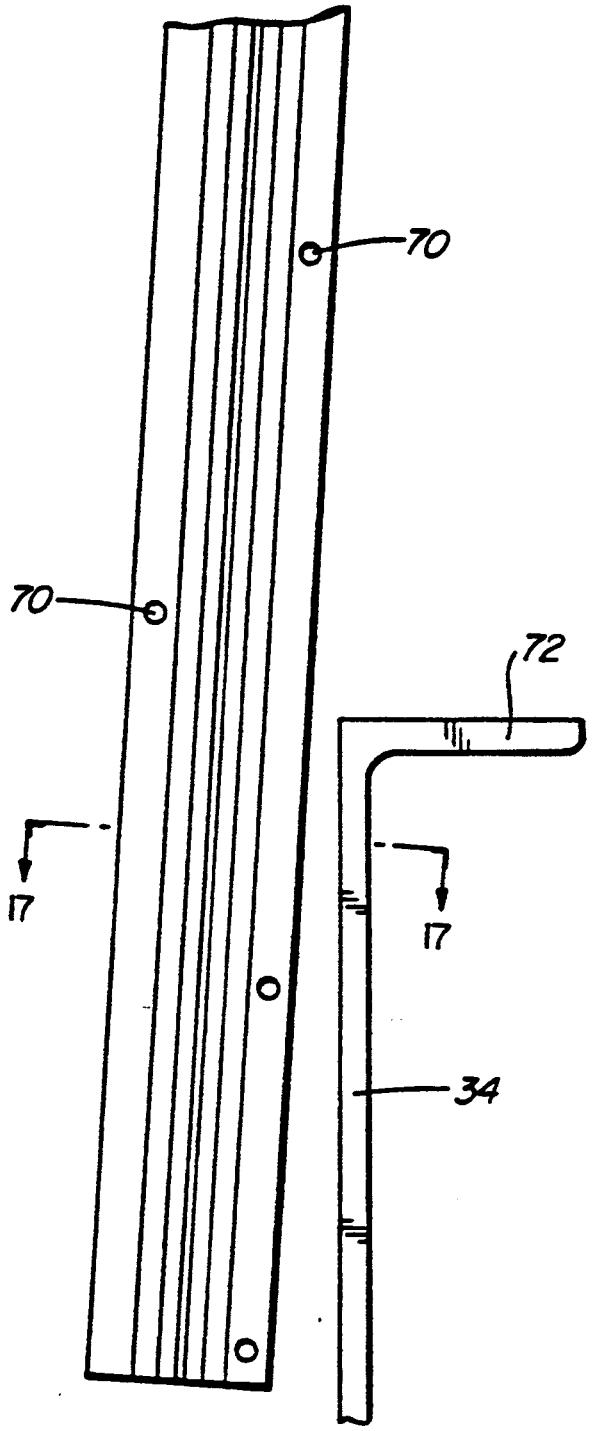
Figure 18:
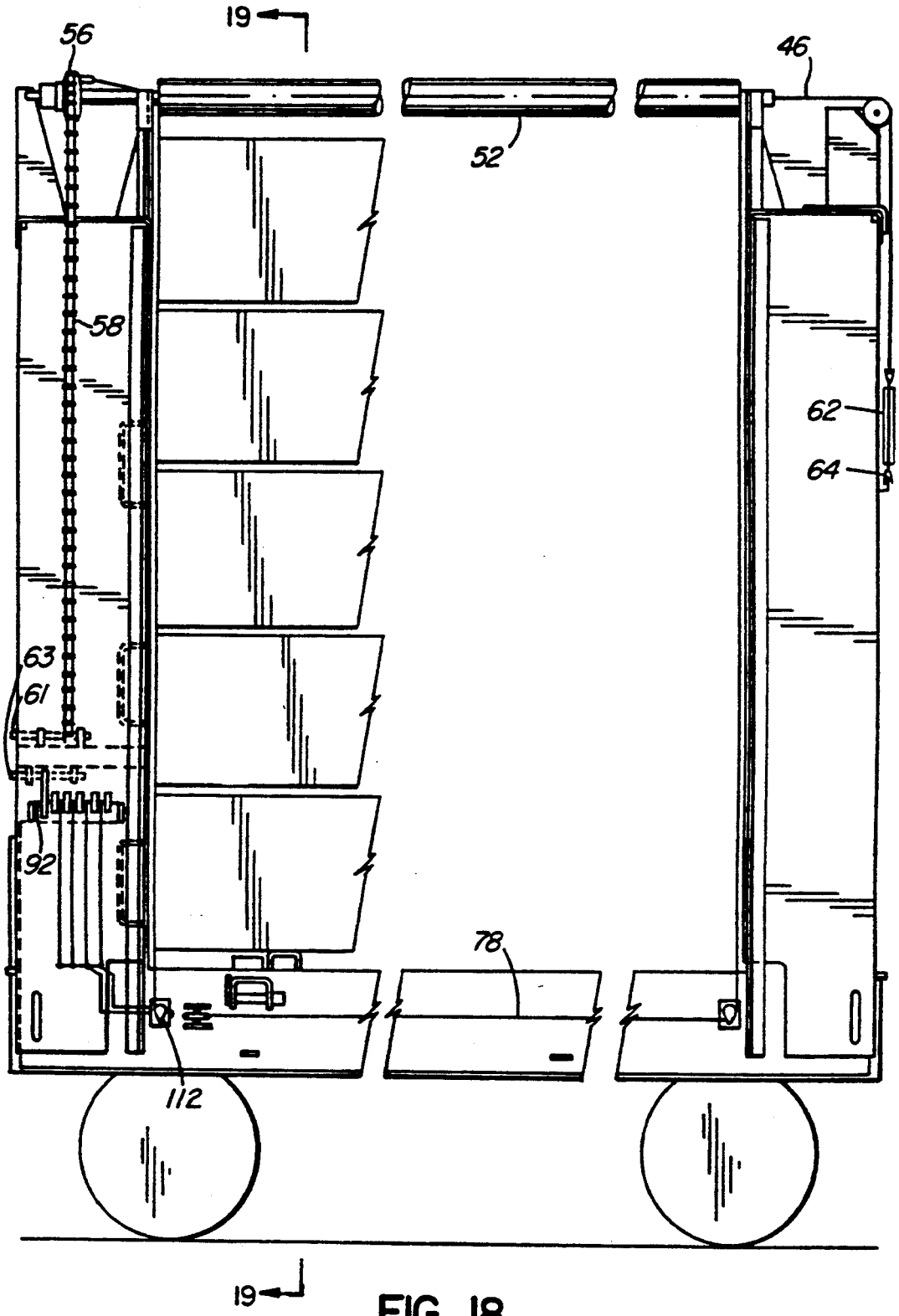
FIG. 18 is a fragmented side view of the "A" and "B" ends of the car.
Figure 19:
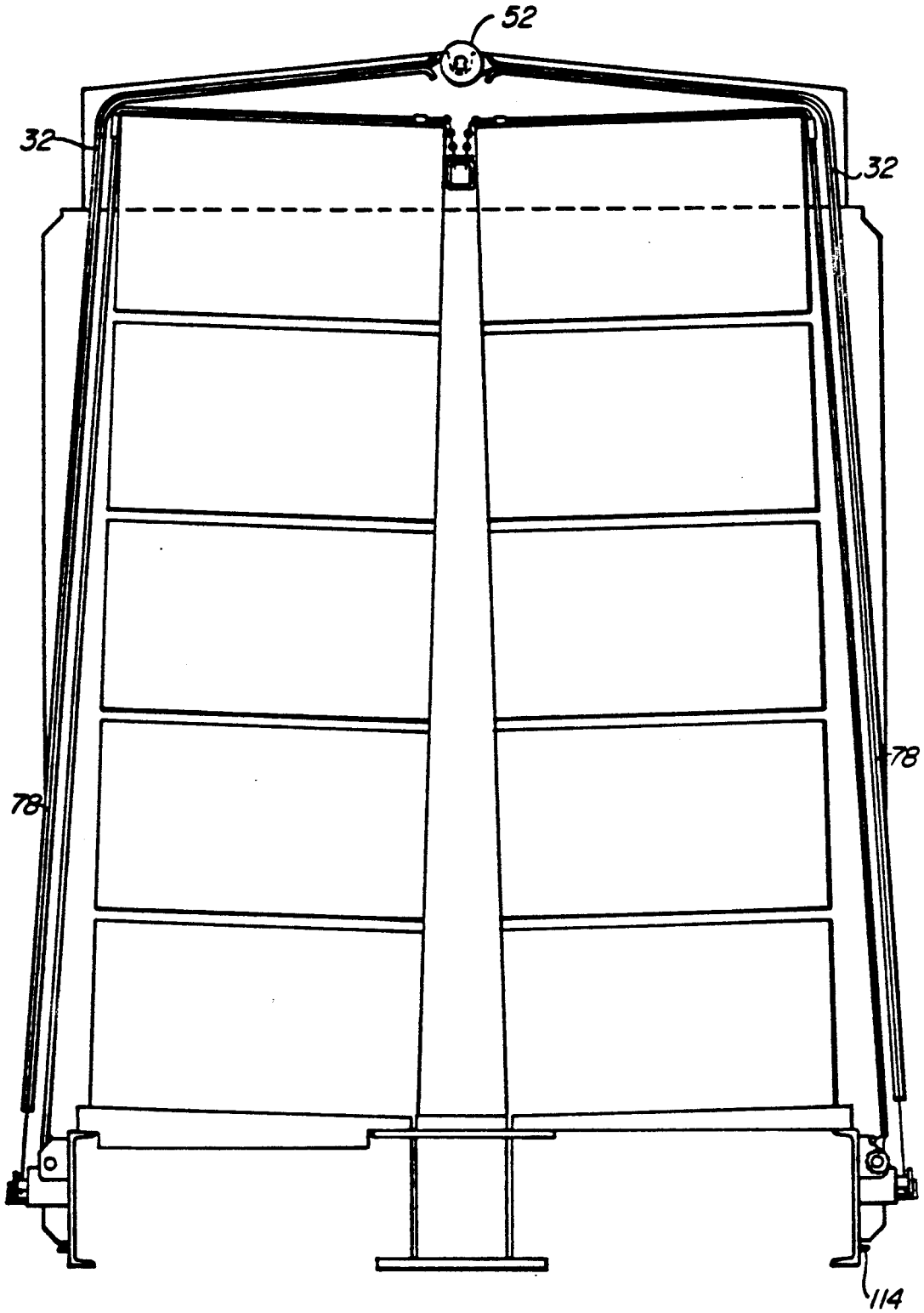
FIG. 19 is a cross-sectional view of the "A" end taken along the lines 19—19 of FIG. 18.

As shown in FIG. 15*a*, 15*b* and 15*c*, the aluminum extruded track 32 follows just outside the outline of the framework 28 (FIG. 2) and is attached to the insides of the bulkheads 21 and 23 respectively. The edges of the tarps 16, 18 travel inside the track 32 and thus provide a weather seal on the ends of the car. The track 32 is extruded from aluminum with a grooved slot 68 running the full length of the track for the tarp edge to run in. The track 32 provides a smooth internal surface in the groove 68 for the running of the tarp edge and also provides a weather seal to prevent moisture from entering the car along the bulkheads. The track 32 is attached to the bulkhead using Hilti nails 70 and caulking is applied to the back of the track 32 to enhance the seal. The track 32 is designed to withstand forklift banging using a solid cross section as shown for example in FIG. 16. A silicon spray is used to reduce friction in the track groove 68 and, as seen in FIG. 15*c*, the track extends down past the top edge 72 of the side sill 34 of the car to ensure a seal on the ends thereof. A stainless steel feeding mechanism 74 is used at the top entry of the track 32 to ensure trouble-free entry of the tarp 16, 18 into the track.

Due to the height of the loads in the cars 10 or 12, there is a steel plate addition 22 on top of bulkhead 21 and 24 on top of bulkhead 23. These additions serve as a support for the top portion of the track 32 and also as a skin to protect the load from the elements. Plates 22 and 24 are welded directly to the top of bulkheads with gussets 25 added for stiffness. See FIGS. 1-3.

Tarps: FIGS. 11-14, 19

Figure 11:
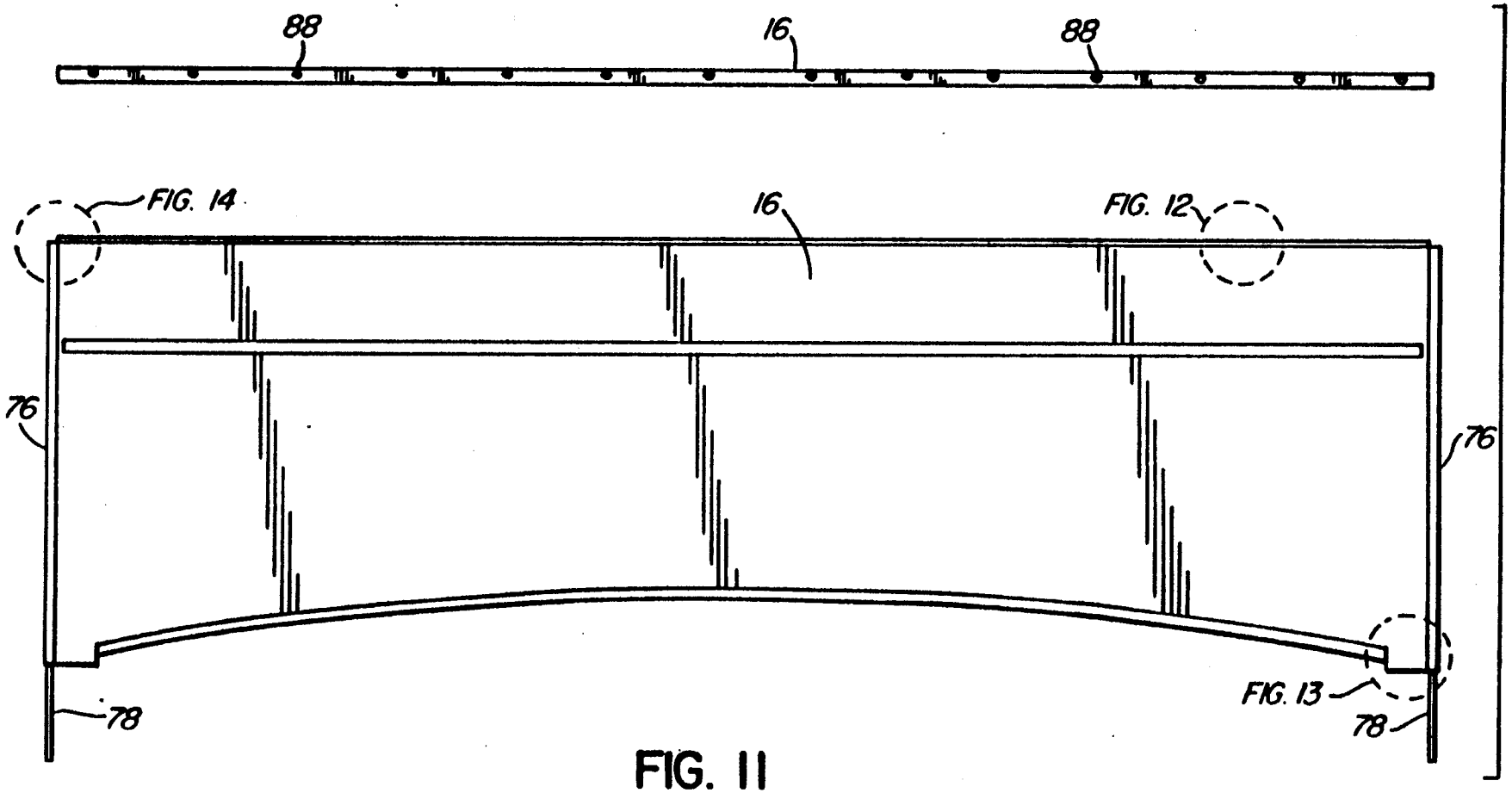
FIG. 11 is a stretch out or development of the tarp assembly.

In FIG. 11, the rear surface of the tarp 16 is shown. Preferably the tarp is made of a vinyl coated polyester such as FALTEX 1861 a substance that is currently used for many truck tarpaulins. Each tarp is approximately 55 feet long and 16½ feet wide, weighing approximately 130 pounds. Each tarp 16, 18 has additional reinforcing of vinyl coated polyester or the like 74 to prevent wear on the tarp, along the edges. The tarp seams are welded together to avoid breakdown of any stitching therein.

Figure 14:
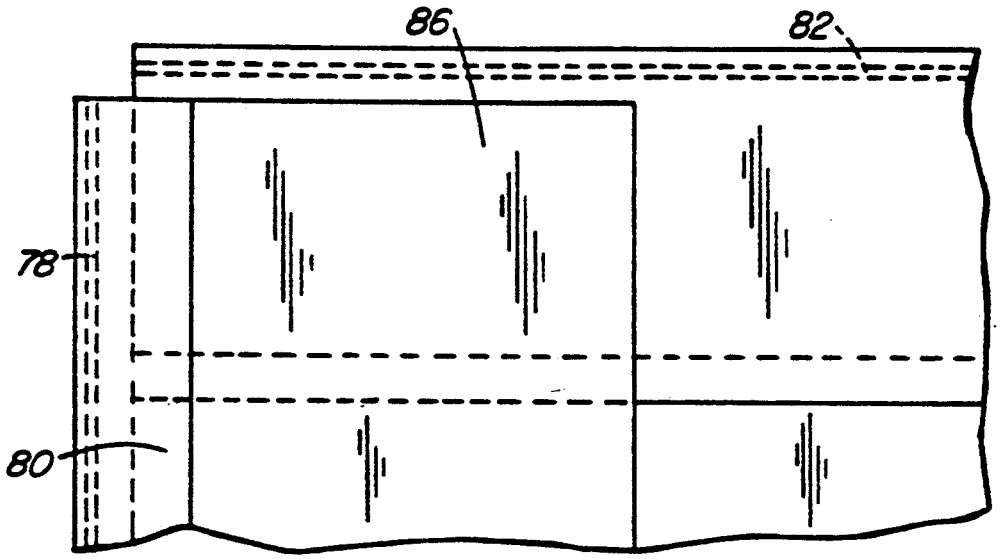
FIG. 14 is a detail of the top corner construction of the tarp assembly.

The side edges 76 of the tarp has a ⅜ inch, diameter wire core rope 78 sewn inside a TEFLON tape 80, FIG. 14, to slide inside the bulkhead track 32. The wire core rope 78 is extended an extra 50 to 100 feet beyond the bottom edge of the tarp to connect to the lowering system described later on in this specification. Using a wire core rope such as 78 extends the life thereof compared to normal rope and also will prevent possible cutting of the rope. TEFLON tape 80 provides better wear resistance in sliding in the groove and also provides less friction.

Figure 12:
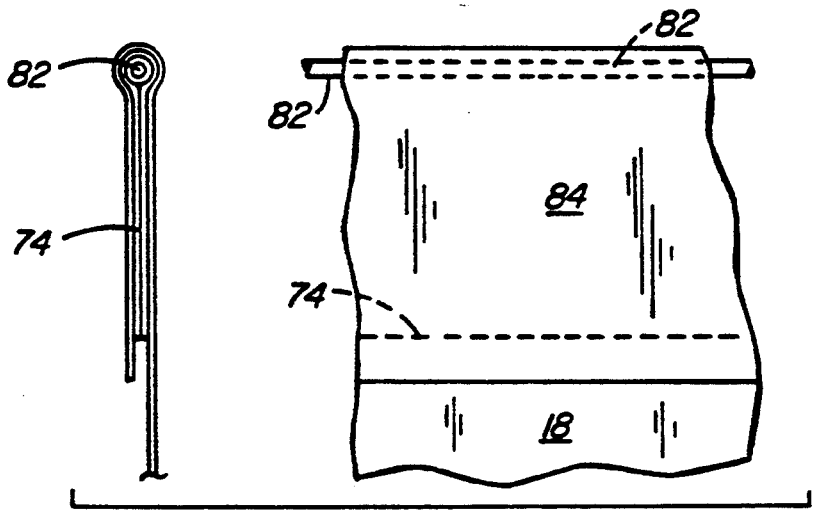
FIG. 12 is a detail of the top construction of the tarp assembly.
Figure 13:
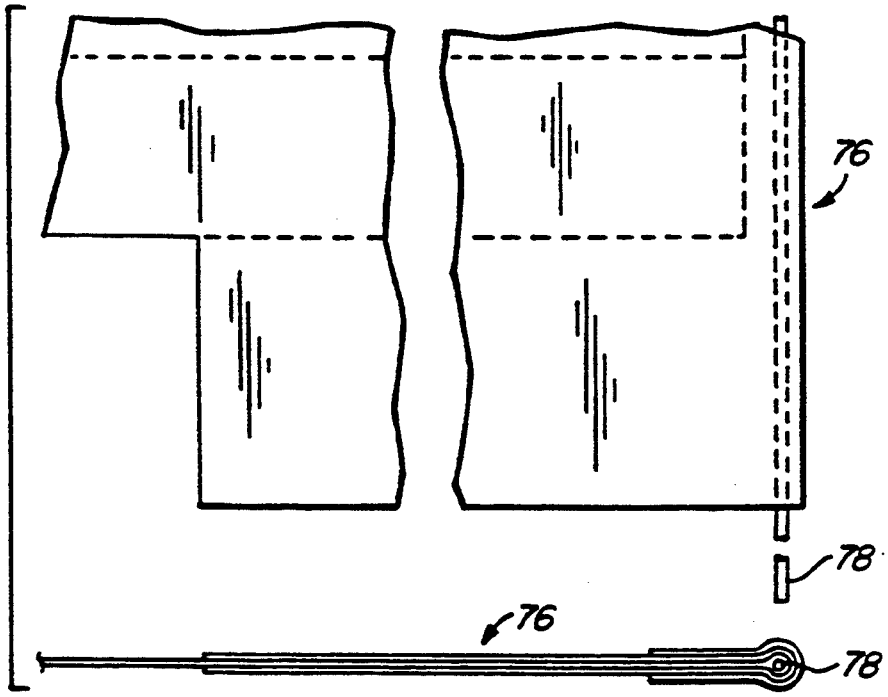
FIG. 13 is a detail of the side construction of the top assembly.

The top edges of the tarps, as shown in FIG. 12, have a ¼ inch diameter hardbraided rope 82 sewn inside a DACRON tape 84 to the tarp material. This slides inside the furling attachment tube 52 and specifically in the grooves 54 thereof so as to attach the tarp to the tube to allow the furling concept to be achieved.

The tarps have additional wear patches 86 placed at the top corners and the outer corners of the load to prevent wear in these higher stressed areas.

The bottom edge of each tarp 16, as shown at the top of FIG. 11, has webbing with attached D-rings 88 and rubber rope 90 sewn therein to provide a means for securing the bottom edge of the tarp to the side sill of the car 10, 12 as shown in FIG. 3.

Winching Mechanism FIGS. 2 and 6-9

The tarp lowering mechanism is located at the "A" end of the car as shown in FIGS. 1-3 and 18 and is in the same location as the furling drive Winch 30. The raising and lowering mechanism are located in a winch control box 94 which is located inside the bulkhead 21. Assembly 94 has a main sprocket shaft 92 on to which the wire core ropes 78, extending out of the four tarp edges are wound intermediate plates 9 spaced along shaft 92. Two other shafts are mounted in the control box assembly 94 and these consist of an upper shaft 61 having a sprocket 57 thereon which receives the lower end of the chain 58 which, at its upper end, is trained around the furling sprocket 56. The third shaft in the control box assembly 94 is shaft 63 which mounts sprocket 65 which is connected to drive sprocket 98 on shaft 92 by means of a half inch pitch chain 67. It will be appreciated that an operator can apply the handle 29 to shaft 63 to rotate shaft 92 to wind on the wire center cords for lowering the tarp. Conversely, the handle can be moved to shaft 61 to rotate that shaft, its sprocket 57 and, by way of the chain 58, rotate the furling tube sprocket to raise the tarps to the open position.

Figure 7:
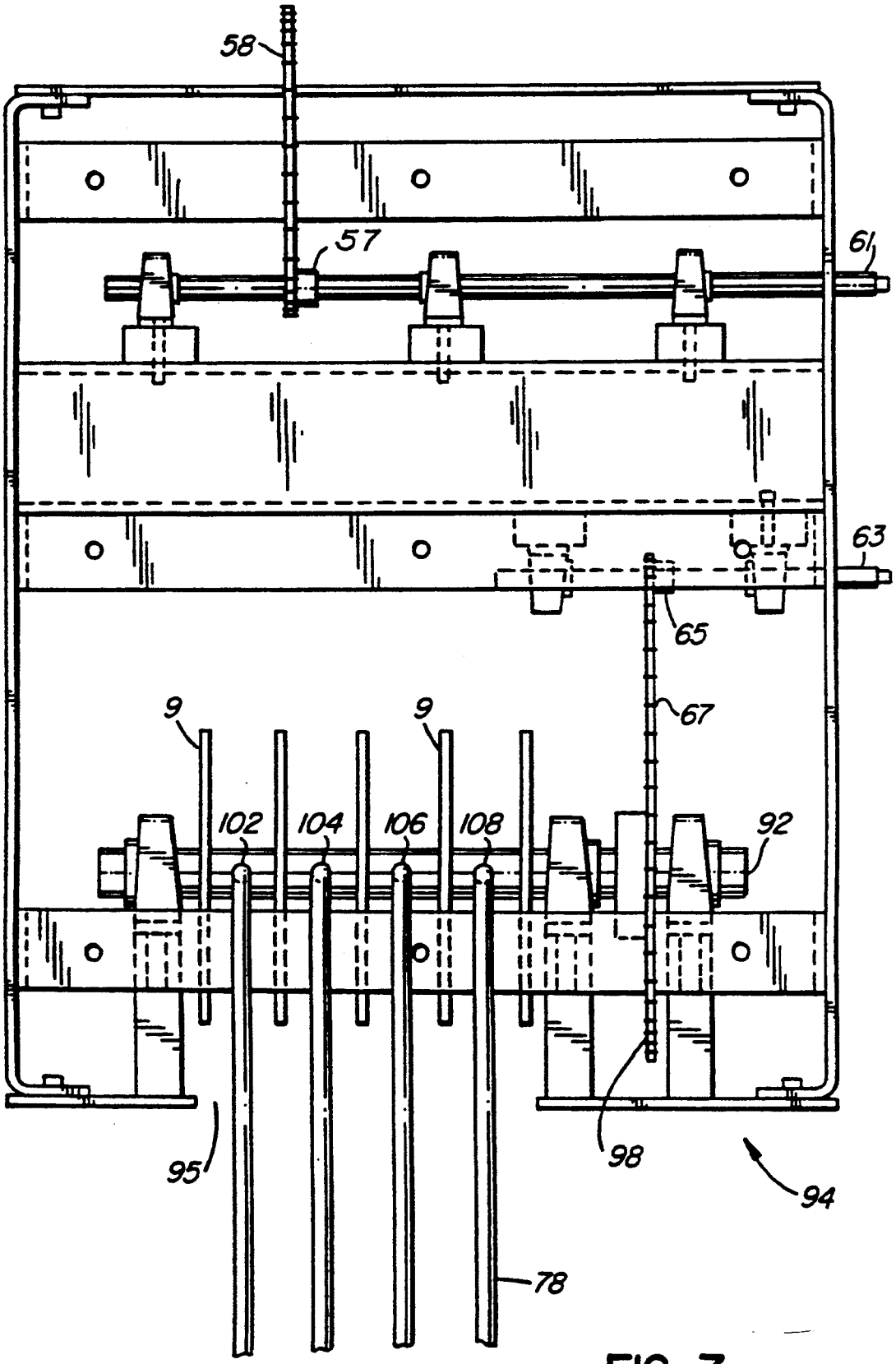
FIG. 7 is a side view of the winch control box assembly (center end pressing omitted from view)
Figure 8:
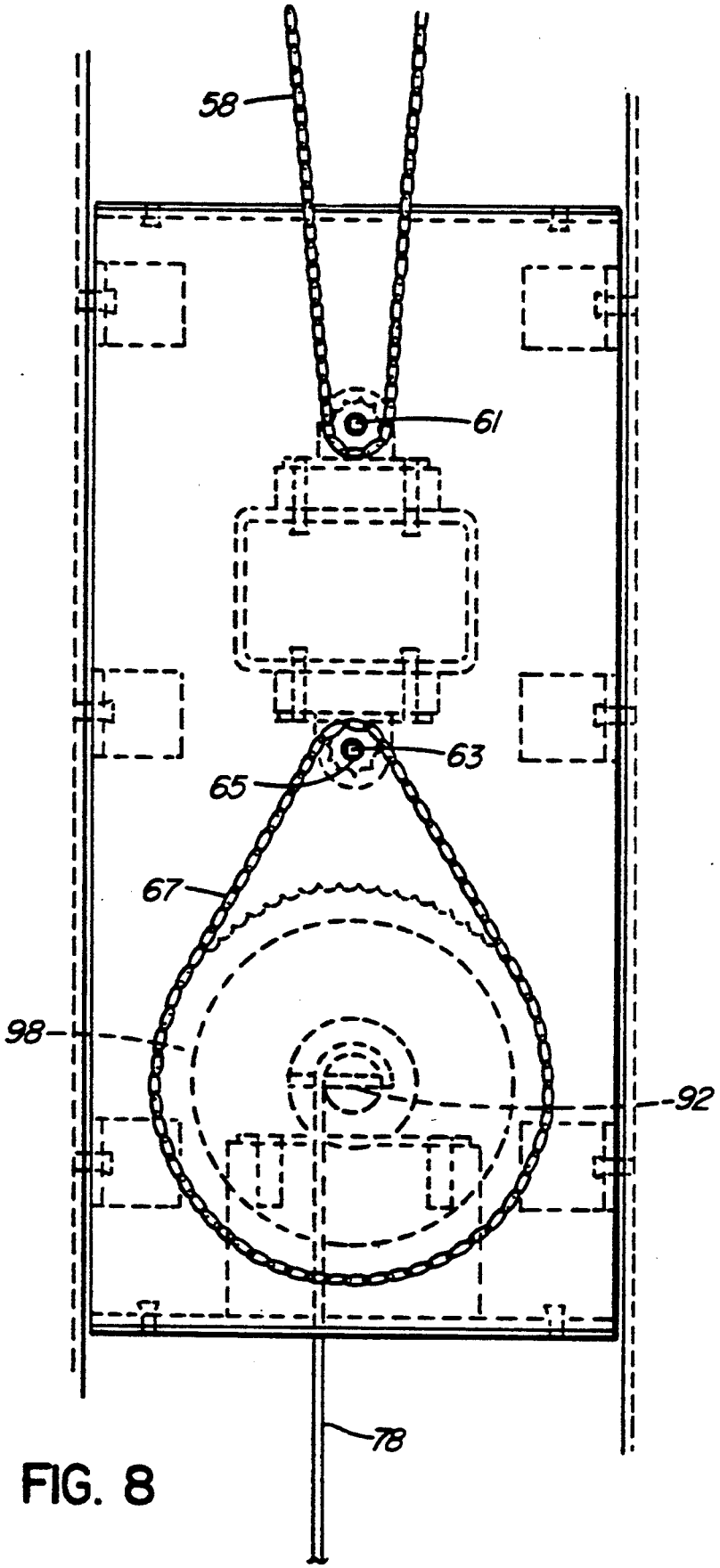
FIG. 8 is an elevation end view of the box in FIG. 7.

Chain 58 is also engaged to a tensioning mechanism 96 (FIG. 6) and the bottom surface of the control box assembly 94 has a wide rectangular slot 95 therein as shown in FIG. 7 and which receives the four ends of the tarp ropes 78 each of which has its inner terminal ends secured to the winch shaft 92 at the countersunk apertures 102, 104, 106 and 108 as shown in FIG. 7.

Figure 9:
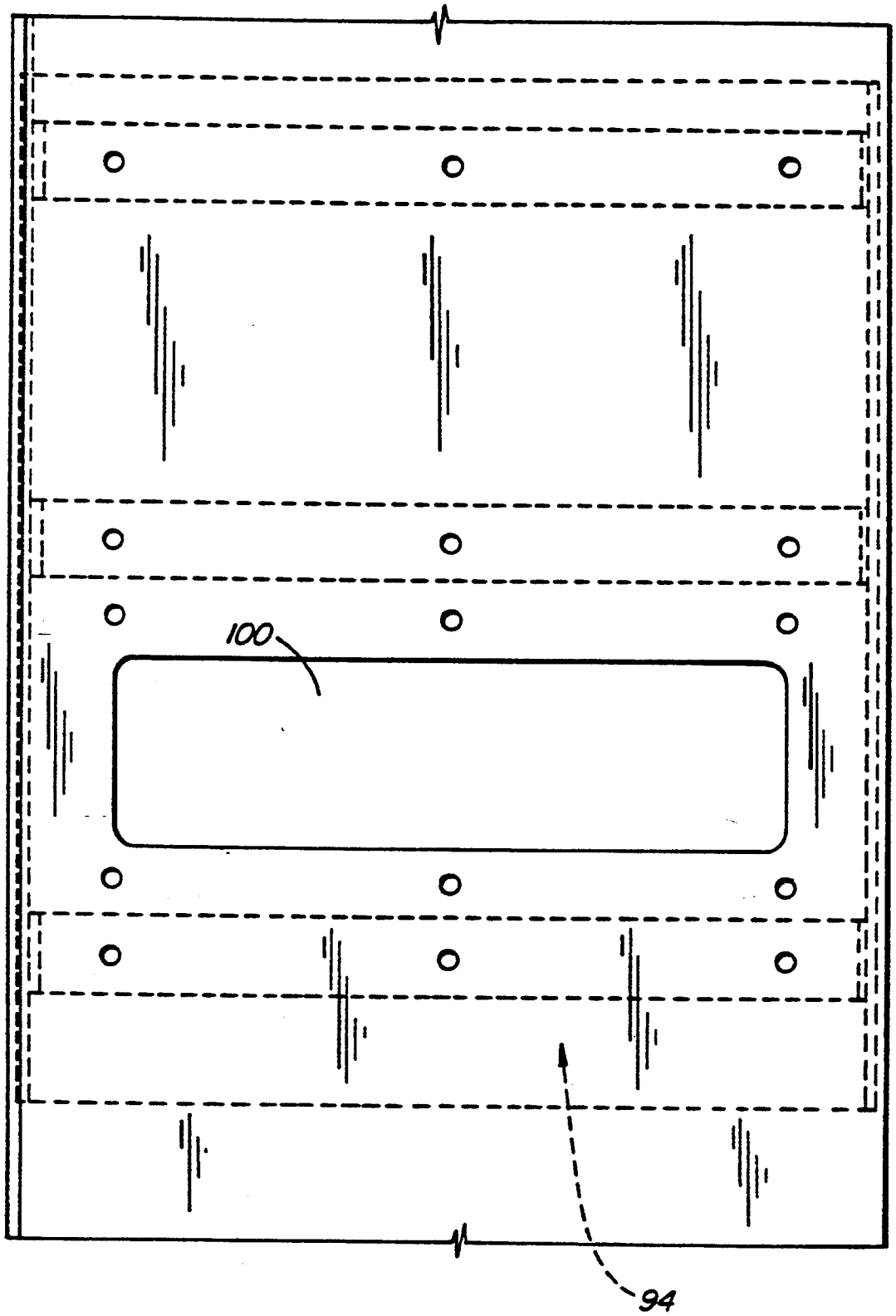
FIG. 9 is a side view of the winch/control box mounting details of the center end pressing.

FIG. 9, a side view of the center end pressing, shows a rectangular aperture 100 that provides an access hatch to the control box assembly 94 so that the chain 67 between the sprocket shaft 92 and the upper sprocket 65 can be connected.

The four wire core rope extensions off the tarps 16, 18 run inside the aluminum extruded track 32 on the bulkheads and come out at the bottom corners. The ropes at the "B" end are then fed around a pulley 110, FIG. 1, at each corner and sent along the bottom of the side sill of the car, preferably inside a pipe or angle iron for protection. They are then sent around two pulleys 112 at the "A" end of the car and sent inside the bulkhead 21 through the aperture 95 to be secured to the winch shaft 92 at the above mentioned locations. After loading and for closing the car, the shaft 92 is rotated, all four corners of the tarps are then pulled down simultaneously to cover the load. The tarps are secured along the bottom edge using the hooks 114, the D-rings and the rubber rope 90.

For unloading, the operator frees the lock on the lowering winch at the "A" end of the car to allow the ropes free travel off the shaft 92 when the tarps are rolled up. Then, at the same location, the raising winch shaft 61 is rotated by handle 29 in a clockwise direction which turns the chain drive, sprocket 56 and the furling shaft, and winding both tarps up and around the shaft and out of the way for unloading. In the pulp car of FIG. 2, the framework 28 consists of nine arches, four located at the "A" end and five at the "B" end as illustrated. These arches are constructed with hollow structural tubing with welded joints. The four arches and five arches respectively are connected with four tiers of aluminum guide rails 42.

The complete system according to the invention should provide trouble free operation during the summer months and, in the winter months, below freezing temperatures are not anticipated to hamper the operation of the components. The top of the tarp has a six degree slope for water run off. Ice and snow may build up on top of the tarp when the car is not moving but this will blow off when the car is in motion due to some movement of the tarpaulin. The winch raising and lowering mechanisms are located inside the bulkhead behind a steel cover to protect them from the elements and from tampering. The aluminum bulkhead track has a very small groove and the potential for ice build up in this is very minimal. The track will be sprayed with silicon to reduce friction and should any freezing occur in the track, a de-icer spray may be used.

The design of the covering system provides for low maintenance and a regular inspection must be followed to ensure the following:

(a) ropes are not cutting or fraying;

(b) track on the bulkheads are allowing free movement of tarps and ropes, not pinching;

silicon is applied for reducing friction;

(d) tarp is not wearing in specific locations; and (e) correct tension in the cable to prevent sagging.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A railroad car with a retractable cover, said car having a bulkhead at each end thereof; said retractable cover comprising:

(a) a pair of tarpaulins each of which is adapted to cover approximately one half of said car between the bulkheads thereof;

(b) a pair of tracks on each bulkhead for guiding said tarpaulins over a load on said car from open to closed positions;

(c) a furling system including a furling tube extending the length of said car between said bulkheads and located between the peaks thereof, said furling system anchoring the upper ends of said tarpaulins;

(d) a cable assembly suspended between the bulkheads of the railroad car to support said furling tube and said tarpaulins; and (e) apparatus connected with said furling system and said tarpaulins for:

(1) drawing said tarpaulins off the furling tube and along said bulkhead tracks to cover a load and close the car, and (2) rotating the furling tube to retract the tarpaulins and open the car.

2. A railroad car according to claim 1 wherein said pair of tracks each comprise a track secured to the inside of the bulkhead and located just outside the outline of the load on said car, a grooved slot in said track running the full length thereof and adapted to receive an edge of said tarpaulin therein, said groove providing a smooth internal surface for movement of said tarp edge and further providing a weather seal for said car when said tarpaulin is in a closed position, said track extending downwardly beyond the top edge of a side will of said car to ensure a seal on the ends thereof, and feeding mechanism at the top entry of said track to provide entry of the tarp therein.

3. A railroad car according to claim 1 wherein said cable assembly comprises a steel cable, suspended above the top cord of said car, and between said bulkheads thereof along the centerline of the car, means for adjusting the tension on said cable, and a tube overlying said cable and having a groove down diametrically opposed sides thereof and extending the full length of said cable, said grooves being adapted to receive the upper marginal edges of said tarpaulins therein; a sprocket gear fitted to one end of said tube and at one end of said car and , an apparatus for rotating said sprocket and furling system to roll said tarpaulins about the furling tube and open the car.

4. A railroad car according to claim 3 wherein said apparatus for rotating said sprocket and furling system comprises a winch mechanism located in the bulkhead of said car on the end of the car common with said sprocket.

5. A railroad car according to claim 1 wherein the apparatus for lowering said tarpaulins to close the car comprises a winch mechanism located within said bulkhead; wire rope means extending from the lower terminal edges of each of said tarpaulins and trained into said bulkhead and connected with said winch mechanism; and means for rotating the winch mechanism to draw said tarpaulins down along said tracks to close the car.

6. A railroad car with a retractable cover, said car having a bulkhead at each end thereof; said retractable cover comprising:

(a) a pair of tarpaulins each of which is adapted to cover approximately one half of said car between the bulkheads thereof;

(b) a pair of tracks on each bulkhead for guiding said tarpaulins over a load on said car from open to closed positions;

(c) a furling system extending the length of said car between said bulkheads and located between the peaks thereof, said furling system anchoring the upper ends of said tarpaulins; and (d) apparatus connected with said furling system and said tarpaulins for:

(1) drawing said tarpaulins off the furling system and along said bulkhead tracks to cover a load and close the car, and (2) rotating the furling system to retract the tarpaulins and open the car;

(e) said furling system comprising a cable, suspended above the top cord of said car and between said bulkheads along the centerline of the car, means for adjusting the tension on said cable, and a tube overlying said cable and having a groove down diametrically opposed sides thereof and extending the full length of said cable, said grooves being adapted to receive the upper marginal edges of said tarpaulins therein; a sprocket gear fitted to one end of said tube and at one end of said car, and an apparatus for rotating said sprocket and furling system to roll said tarpaulins about the furling tube and open the car.

7. A railroad car according to claim 6, wherein said apparatus for rotating said sprocket and furling system comprises a winch mechanism located in the bulkhead of said car on the end of the car common with said sprocket.

* * * * *